US005853219A

United States Patent [19]

Santuccio

[11] Patent Number: 5,853,219

[45] Date of Patent: Dec. 29, 1998

[54] SAFETY WALKER ASSEMBLY

[76] Inventor: Kathleen M. Santuccio, 5 Corliss Ave., Gloucester, Mass. 01930

[21] Appl. No.: 851,746

[22] Filed: May 6, 1997

[51] Int. Cl.[6] ..... A47D 13/04

[52] U.S. Cl. ..... 297/5; 135/66; 135/67

[58] Field of Search ..... 297/5, 6; 135/66, 135/67, 910, 911

[56] References Cited

U.S. PATENT DOCUMENTS

| | | | |
|---|---|---|---|
| D. 324,504 | 3/1992 | Olsen . | |
| 2,966,578 | 12/1960 | Coffey | 135/910 X |
| 4,062,371 | 12/1977 | Bolen | 135/66 |
| 4,298,016 | 11/1981 | Garelick | 135/67 |
| 4,850,641 | 7/1989 | Walker . | |
| 5,197,501 | 3/1993 | Regatz | 135/66 |
| 5,219,402 | 6/1993 | Kondo et al. | 135/66 |
| 5,311,880 | 5/1994 | Lancaster et al. | 135/67 X |
| 5,511,571 | 4/1996 | Adrezin et al. | 135/66 |
| 5,588,735 | 12/1996 | Harada | 135/910 X |

*Primary Examiner*—Jose V. Chen
*Assistant Examiner*—Stephen Vu
*Attorney, Agent, or Firm*—Don Halgren

[57] ABSTRACT

The disclosure relates to a safety walker assembly to assist handicapped people in walking. The safety walker assembly comprises a pair of side frames joined together by a horizontal bar arrangement to form a lightweight three sided structure. A handle bar grip member is arranged on each side frame, and an actuatable "emergency" alert device is attached to the structure, arranged to be switchable on and off by a user of the safety walker assembly. The alert device is arranged to activate upon tipping of the walker from its normal vertical.

3 Claims, 1 Drawing Sheet

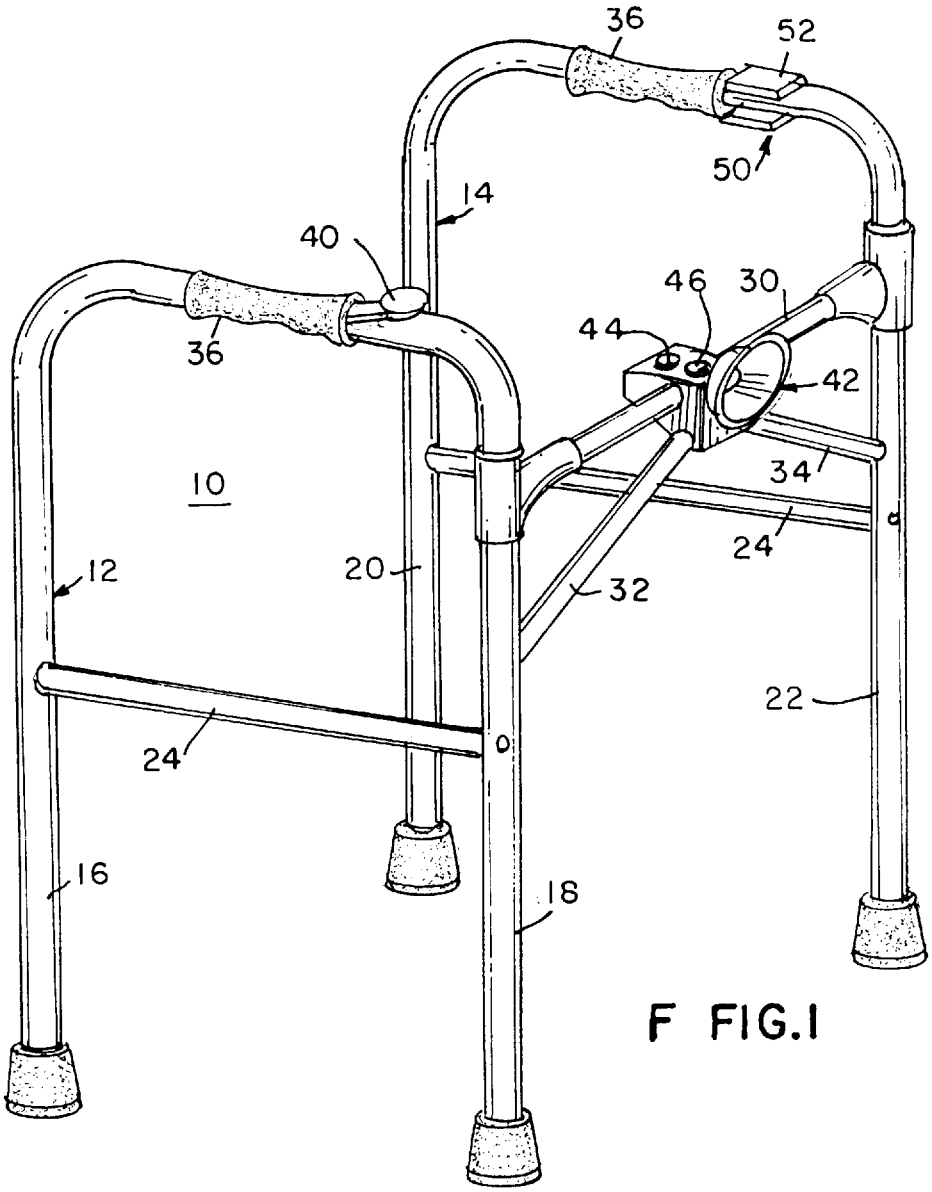
F FIG.1
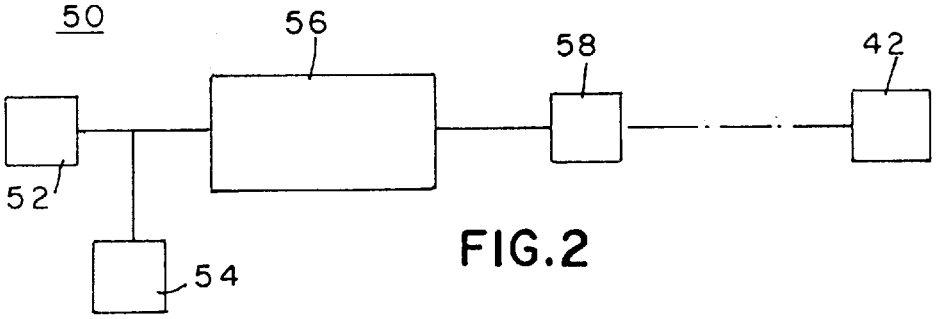
FIG.2

SAFETY WALKER ASSEMBLY

BACKGROUND OF THE INVENTION

1. Field of the Invention

This invention relates to walker devices for handicapped and elderly people, and more particularly, to safety devices on those walkers.

2. Prior Art

Handicapped and elderly people are often susceptible to the problem of immobility. One solution to that problem, has been the lightweight frame mechanism known as a walker. The typical walker comprises a generally U-shaped tubular frame assembly made of aluminum for its light weight, and strength, to assist people in going from one location to another.

Such a walker may, for instance, be seen in U.S. Pat. No. 4,850,641 to Walker, which shows a carrying pouch and seat for such devices.

A further walker device, is shown in U.S. Design Pat. No. 324,504 to Olsen, having a carrier shown therewith.

In view of the difficulties that such handicapped and elderly people have in utilizing these devices, it is necessary to have safety features thereon, to assist them in getting around, and/or alerting someone should they have a problem.

It is thus an object of the present invention, to provide an improvement over the prior art.

It is a further object of the present invention, to provide a walker with assist and/or emergency equipment thereon.

BRIEF SUMMARY OF THE INVENTION

The present invention comprises a walker assembly, made from a plurality of aluminum tubes joined together.

The walker assembly comprises a first and a second side frame of generally inverted U-shape, each having a pair of parallel side columns with a lowermost end. Each lowermost end has a rubber cushion, or foot, thereon. A transverse support bar extends between the front and rear columns on each side of the walker assembly. A transverse connector bar is arranged between each inverted U-shape side assembly, so as to connect those side assemblies securely together. The connector bar may have several other diagonal struts supported there across to provide rigidity and safety between the side frame members.

Each side frame assembly preferably has a handlebar or handrest along a horizontal mid-portion thereof.

As a first safety feature, a manually operable signal bell may be arranged adjacent to the handrest on one horizontal portion of the side frame assembly. This permits a patient to utilize the walker to alert others of likely diminished hearing/eyesight capacity, that a patient with a walker is coming along a hallway. A further safety feature of the present invention, includes a small battery powered lamp, so as to permit the user to walk in hallways which are dimly lit, or to provide visual warning or notice to others that a patient is using that walker. The lamp assembly may be attached at a midpoint of the horizontal strut joining the left and right handed side assemblies together. The lamp assembly may have an on-switch and an off-switch.

In a further embodiment of the present invention, a tilt alarm is attached to one of the other side assemblies. The tilt alarm comprises an actuator switch, a battery, a tilt sensor, and an audible and/or visual alarm connected therewith. The tilt switch may comprise a mercury switch or the like, which when the system is activated, permits an alarm to go off when the frame assembly is not in a proper upright position. The alarm may be electrically connected to the lamp at the crossbar of the frame assembly to make the lamp go on and off at rapid intervals, to indicate that the patient utilizing the walker may have fallen, or that the walker has tipped. The audible alarm may comprise a buzzer or other signaling bell, which indicates that the U-walker may have tipped to one side by the patient falling or the like.

The on-off switch for the walker alarm system is operable and actuated when the walker is initially used by the patient. Should the walker assist device assembly be tipped, the electrical switch assembly within the actuation device will complete the circuit so as to set off the buzzer, and/or light in an intermittent and alarm type fashion. If the patient were no longer using the walker, or putting it sideways, for instance in a car, the switch would merely be shut off, so as to disactivate the alarm system.

Thus, there has been shown in this invention, a unique walker assembly having improvements which permit a disabled, elderly, or handicapped person, to walk in a fairly normal manner, and assist that person in nighttime or dark use of that walker. Portions of those assist components, are also utilizable as emergency alarms, to indicate that the walker assembly has been tipped, for instance by the patient using that assembly may have fallen or cannot reach the device itself.

The invention thus comprises a safety walker assembly to assist handicapped people in walking, the safety walker assembly comprising a pair of side frames joined together by a horizontal bar arrangement to form a lightweight three sided structure; a handlebar grip member arranged on each side frame; and an actuatable alert device attached to the structure, arranged to be switchable on and off by a user of the safety walker assembly. The alert device comprises a battery powered lamp assembly. The alert device may also comprise a battery powered audible alarm device. The alert device includes a tilt actuatable switch to send a signal to the alarm device when the walker assembly is tipped from the vertical position to an angled position with respect to the horizontal.

The invention also includes a method of providing a safety alert signal for an aluminum framed handicapped walker assembly, comprising the steps of: providing a three sided tubular frame walker assembly having a pair of handlebar grip portions; attaching an electrical lamp with an actuatable switch, to the tubular frame; a and connecting an actuatable tilt sensor of an alarm system, to the tubular frame together with a battery in electrical communication with an alarm to provide an audible or visual alarm if the tubular frame is tipped from a horizontal orientation when the alarm system is actuated. The method of providing a safety alert signal for an aluminum framed handicapped walker assembly also comprises the step of: attaching an on/off switch to the alarm system so as to permit the system to be de-activated when the walker is not in use.

BRIEF DESCRIPTION OF THE DRAWINGS

The objects and advantages of the present invention will become more apparent when viewed in conjunction with the following drawings, in which:

FIG. 1 is a perspective view of a walker assembly constructed according to the principles of the present invention; and FIG. 2 is a block diagram showing the components of the safety device system utilizable on the walker assembly.

DESCRIPTION OF THE PREFERRED EMBODIMENTS

The present invention comprises a walker assembly 10, made from a plurality of aluminum tubes joined together.

The walker assembly 10 comprises a first and a second side frame 12 and 14 of generally inverted U-shape, each having a pair of parallel side columns 16, 18 and 20, 22, each with a lowermost end. Each lowermost end has a rubber cushion, or foot, thereon. A transverse support bar 24 extends between the front and rear columns 16 and 18, and 20 and 22, on each side of the walker assembly 10. A transverse connector bar 30 is arranged between each inverted U-shape side frame 12 and 14, so as to connect those side frames 12 and 14 securely together. The connector bar 30 may have several other diagonal struts 32 and 34 supported thereacross, as shown in FIG. 1, to provide rigidity and safety between the side frame members 12 and 14.

Each side frame 12 and 14 preferably has a handlebar or handrest 36 along a horizontal mid-portion thereof, as may be seen in FIG. 1.

As a first safety feature, a manually operable signal bell 40 may be arranged adjacent to the handrest 36 on one horizontal portion of one side frame 12. This permits a patient to utilize the walker assembly 10 to alert others that the patient is coming along a hallway. A further safety feature embodiment of the present invention, includes a small battery powered lamp 42, so as to permit the user to walk in hallways which are dimly lit, or to provide visual warning or notice to others that a patient is using that walker 10. The lamp assembly 42 may be attached at a midpoint of the horizontal connector bar 30 joining the left and right handed side frames 12 and 14 together. The lamp assembly 42 may have an onswitch 44 and an off-switch 46.

In a further embodiment of the present invention, a tilt alarm system 50 is attached to one of the other side frames 14. The tilt alarm system 50 comprises an actuator switch 52, a battery 54, a tilt sensor 56, and an audible and/or visual emergency type alarm 58 (loud & bright so as to not be confused the bell 40 or simple fluttering light) electrically connected therewith, as shown in FIG. 2 in block diagram. The tilt sensor 56 may comprise a mercury switch or the like, which when the system is activated, permits the alarm 58 to go off when the walker assembly 10 is not in a proper upright position. The alarm 58 may be electrically connected to the lamp 42 assembly at the connector bar 30 of the walker assembly 10 to make the lamp assembly 42 go on and off at rapid intervals, to indicate that the patient utilizing the walker assembly 10 may have fallen, or that the walker assembly 10 has tipped, the light being brighter during such an alarm situation because of a further lamp or more powerful battery/bulb therewithin. The audible portion of the alarm 58 may comprise a buzzer or other electronically actuatable signaling bell, which indicates that the walker assembly 10 may have tipped to one side by the patient falling or the like.

The on-off switch 52 for the walker tilt alarm system 50 is operable and may be actuated to "ready" status when the walker assembly 10 is initially used by the patient. Should the walker assembly 10 thereafter become tipped, , say for example, more than 30 degrees from vertical, the tilt sensor 56 within the tilt alarm system 50, will complete the circuit so as to set off the buzzer, and/or light alarm 58 in an intermittent and "emergency alarming" type fashion. If the patient were no longer using the walker assembly 10, or putting it sideways, for instance in a car, the actuator switch 52 would merely be shut off, so as to de-activate the tilt alarm system 50. In a further embodiment, it is also contemplated that the buzzer and/or alarm could be activated by a user of such a walker is the user believed that an emergency is eminent.

Thus, there has been shown in this invention, a unique walker assembly having improvements which permit a disabled, elderly, or handicapped person, to walk in a fairly normal manner, and assist that person in nighttime or dark use of that walker. Portions of those assist components, are also utilizable as emergency alarms, to indicate that the walker assembly has been tipped, for instance by the patient using that assembly may have fallen or cannot reach the device itself, or actuated by a user of such walker believing that an emergency does or is about to exist.

I claim:

1. A vertically oriented safety walker assembly to assist handicapped people in walking, said safety walker assembly comprising:

a pair of side frames spaced at a certain distance apart, each having an inverted U shape with a front vertical leg, a rear vertical leg and a connecting portion, a horizontal bar connecting said front legs of said side frames to form a lightweight three-sided structure;

a strut arrangement secured between said front vertical legs to provide rigidity to said walker assembly;

a handlebar grip member arranged on each of said side frames; and an automatically actuatable alert device comprising a battery powered lamp assembly and an audible alarm attached to said horizontal bar, said device also including a tilt actuatable switch to send a signal to said alarm when said walker assembly is tipped from the vertical position to an angled position with respect to a horizontal floor surface, said device is arranged to actuate when said safety walker assembly no longer supports a user.

2. The safety walker assembly to assist handicapped people in walking as recited in claim 1, including:

an on/off switch to permit actuation of said device, without the walker being tipped.

3. A method of providing a safety alert signal for an aluminum framed vertically oriented handicapped walker assembly, comprising the steps of:

providing a pair of side frames spaced at a certain distance apart, each having an inverted U shape with a front vertical leg, a rear vertical leg and a connecting portion, a horizontal bar connecting said front legs of said side frames to form a lightweight three-sided structure and a strut arrangment secured between said front vertical legs to provide rigidity to said walker assemble;

attaching an electrical lamp with an actuatable switch, to said tubular frame;

connecting an actuatable tilt sensor of an alarm system, to said tubular frame together with a battery in electrical communication with an alarm to provide an audible and/or visual alarm upon said tubular frame being tipped from a horizontal orientation when said alarm system is actuated;

attaching an on/off switch to said alarm system so as to permit said system to be de-activated when said walker is not in use; and arranging said on/off switch to be actuated by a user of said walker assembly to sound and flash an emergency signal when said switch is triggered even when said walker assembly is upright and vertical.

* * * * *